United States Patent [19]

Wong

[11] 4,329,893

[45] May 18, 1982

[54] DEVICE AND METHOD FOR HANDLING TRIM STRIP IN A WEB SLITTER

[75] Inventor: George H. Wong, Roscoe, Ill.

[73] Assignee: Beloit Corporation, Beloit, Wis.

[21] Appl. No.: 161,133

[22] Filed: Jun. 19, 1980

[51] Int. Cl.[3] ..... B26D 1/24; B65H 35/02

[52] U.S. Cl. ..... 83/24; 83/121; 83/152; 83/422

[58] Field of Search ..... 83/98, 100, 152, 154, 83/923, 121, 22, 24, 422

[56] References Cited

U.S. PATENT DOCUMENTS

| | | | |
|---|---|---|---|
| 453,859 | 6/1891 | Flickinger et al. | 83/121 |
| 2,786,673 | 3/1957 | Bridenstine | 83/152 X |
| 3,103,842 | 9/1963 | Winkler et al. | 83/152 X |
| 3,200,685 | 8/1965 | Heilbrunn | 83/98 |
| 3,252,366 | 5/1966 | Karr | 83/98 |
| 3,405,855 | 10/1968 | Daly et al. | 226/1 |
| 3,695,131 | 10/1972 | Zimmermann | 83/152 X |
| 4,231,272 | 11/1980 | Crouse | 83/98 |

*Primary Examiner*—Frank T. Yost

*Attorney, Agent, or Firm*—Hill, Van Santen, Steadman, Chiara & Simpson

[57] ABSTRACT

Trim strip in a web slitter having upper and lower rotary slitting means cooperating at a severance point for trimming a strip from the edge portion of a travelling web is engaged on a cylindrical rotary trim biasing and guiding surface associated with the lower slitting means. The trim strip is retained in wrapping engagement on the rotary surface by pressure differential and thereby positively transported away from the severance point into a chute. At a point spaced from the severance point the trim strip is stripped from the rotary surface for onward movement in the chute.

14 Claims, 4 Drawing Figures

22
II
10
12
W
23
29
14
21
T
15
24
30
20
18
19
18
19
II 10
11
T
12
W
14
28
25
27
13
24
III
31
30
III
15
T
17
19
18

27
28
24
31
30

27
31
T
24
30

DEVICE AND METHOD FOR HANDLING TRIM STRIP IN A WEB SLITTER

This invention relates to the handling of the marginal strip of material customarily trimmed from a travelling paper web generally at a suitable location upstream from a winder.

Ever higher speeds of operation characterize the paper making industry. This includes the slitting and winding of the paper web into rolls of desired length. Since the edges of newly made paper web are generally not perfectly straight, they are customarily trimmed-off before the web is wound into one or more rolls, thereby assuring uniformity in the width of the rolled web. Inasmuch as the strip of material trimmed from the travelling web is freed from the propulsion force driving the web, problems have been encountered in moving the trim strip onward in the customarily trim chute associated with the slitter.

A fairly sucessful arrangement for assuring onward movement of the trim strip from the slitter into and through the chute is represented in U.S. Pat. No. 3,252,366 which discloses an air guiding trim chute utilizing high velocity air jets. The high air velocities cause noise levels well over the 90 decibels allowable for normal working conditions according to present governmentally established guide lines.

An important object of the present invention is to overcome the disadvantages, drawbacks, inefficiencies, shortcomings and problems inherent in prior trim strip handling arrangements.

Another object of the present invention is to provide a new and improved device and method for handling trim strip in a web slitter efficiently and quietly.

A further object of the invention is to provide new and improved device and method for handling trim strip in a web slitter without any need for noisy air.

Still another object of the invention is to provide a new and improved device and method for handling trim strip in a web slitter efficiently and at the speed of travel of the travelling web from which the strip has been trimmed.

The present invention provides a device for handling trim strip in a web slitter having upper and lower rotary slitting means cooperating at a severance point for trimming a strip from the edge portion of a travelling web, and a trim chute for receiving the trim strip, said device comprising a cylindrical rotary trim biasing and guiding surface associated with said lower slitter means and adapted for engagement by said trim strip, said surface having pressure differential means for retaining said trim strip in wrapping engagement on said surface for thereby positively transporting the trim strip away from said severance point into said chute; and means spaced from said severance point for stripping the trim strip from said surface for onward movement in said chute.

The invention also provides a method of handling trim strip in a web slitter having upper and lower rotary slitting means cooperating at a severance point for trimming a strip from the edge portion of a travelling web, and a trim chute for receiving the trim strip, said method comprising engaging said trim strip on a cylindrical rotary surface associated with said lower slitter means, retaining said trim strip in wrapping engagement on said surface by pressure differential and positively transporting the trim strip away from said severance point into said chute; and at a point spaced from said severance point stripping the trim strip from said surface for onward movement in said chute.

Other objects, features and advantages of the invention will be readily apparent from the following description of a certain representative embodiment thereof, taken in conjunction with the accompanying drawing although variations and modifications may be effected without departing from the spirit and scope of the novel concepts embodied in the disclosure and in which.

Figure 1:
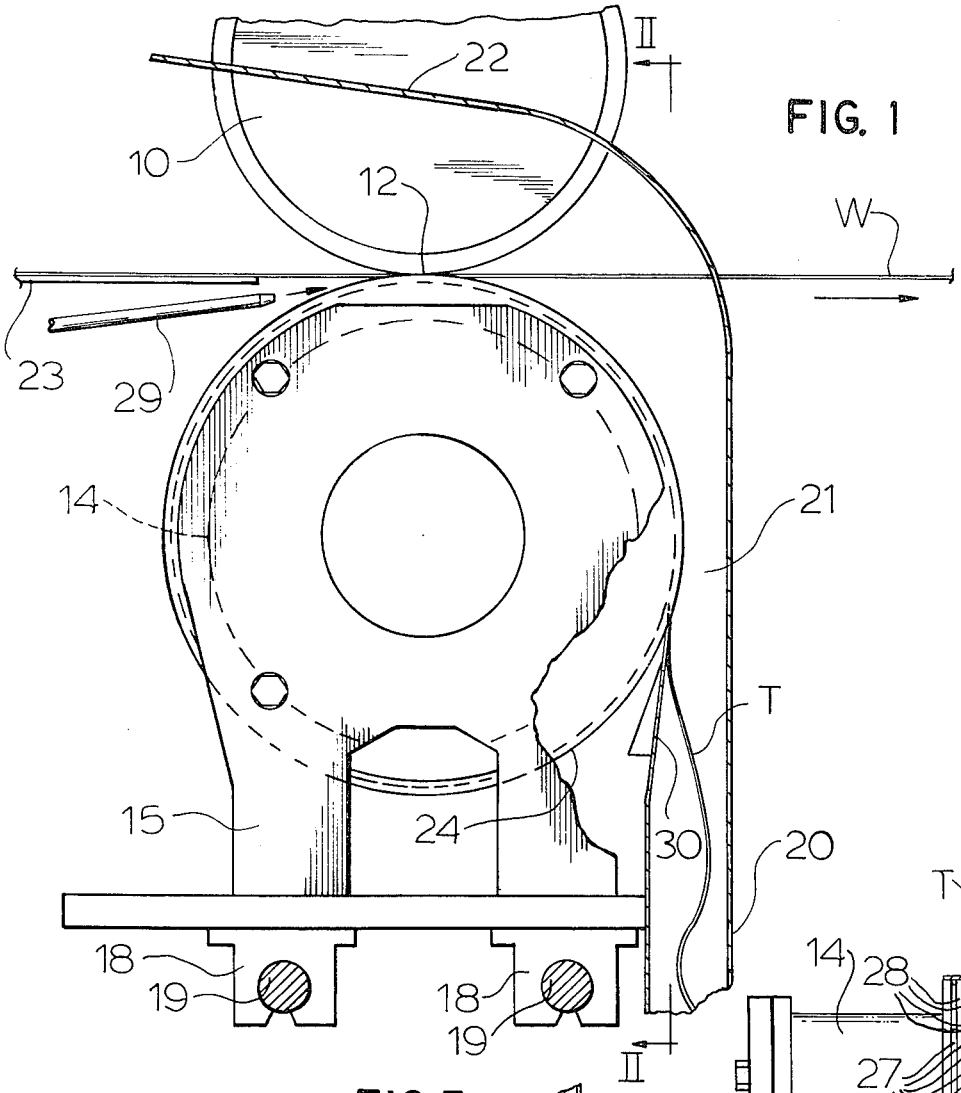
FIG. 1 is a more or less schematic side elevational view showing a slitter mechanism embodying the present invention.
Figure 2:
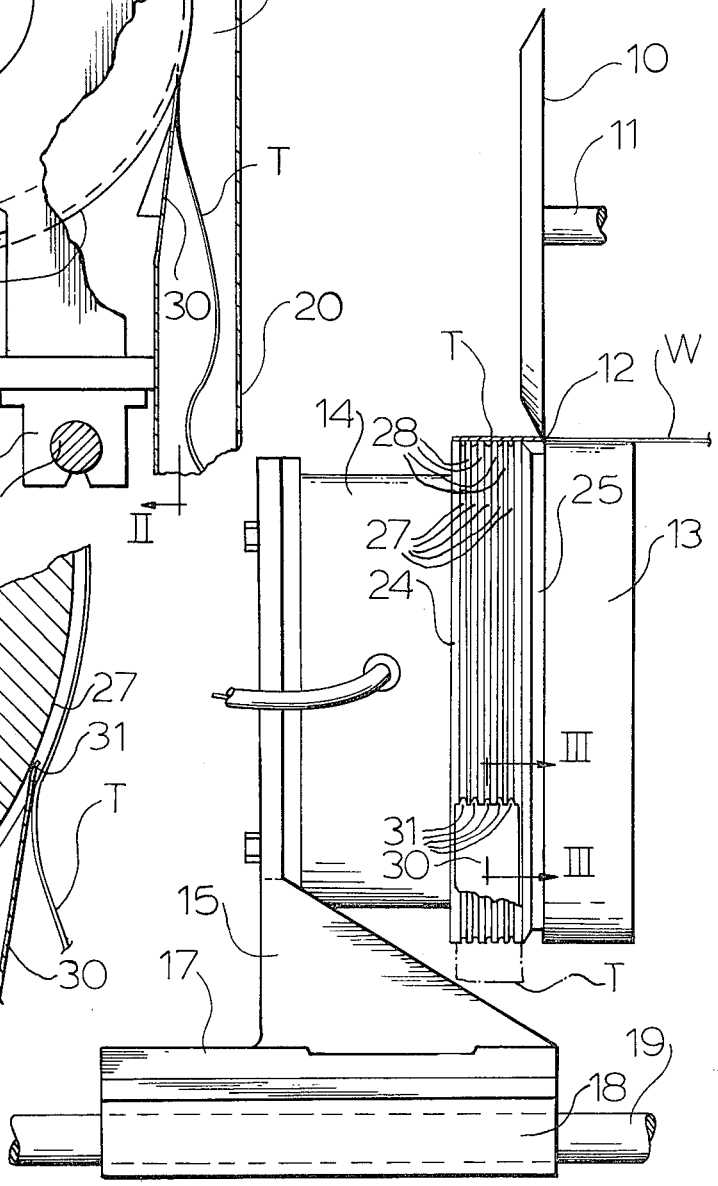
FIG. 2 is an elevational view taken substantially along the line II—II of FIG. 1.

As shown in FIGS. 1 and 2, a web W travelling continuous at what may be high speed toward a high speed winder has a marginal strip T trimmed-off by upper and lower slitting means comprising an upper beveled slitting knife 10 which may be freely rotatably mounted by means of a shaft 11 and which cooperates at a severance point 12 with a lower slitting band 13. Although the slitting band 13 may be freely rotated in supporting relation to the web W, in this instance the slitting band is desirably rotatably supported and driven by means of an electrical motor 14 mounted on a bracket 15 carried by a base 17 provided therebelow with runner bearings 18 engaged with supporting rails 19 extending transversely below the path of travel of the web W and along which the motor and slitting band mount is adapted to be adjustably moved for efficient slitting location relative to the width of the web W. There may be means (not shown) for locking the motor and slitting band mount in adjusted position on the rails 19.

From the slitting point 12, the strip of trim T is directed downwardly into a trim chute 20 providing a trim receiving passage 21 which leads away from the trim point 12. To facilitate movement of the strip T into the chute 20, the upper end of the chute is provided with a lead-in flange 22 which overlies the severance point 12 and curves downwardly to join the front wall of the chute 20. Upstream from the severance point 12 the web W including the margin to be trimmed-off may be supported by a table 23.

From the severance point 12, the trim strip T is bias guided into the chute passage 21 by means comprising a cylindrical rotary trim biasing surface 24 co-rotatively joined with and desirably of the same diameter as the slitter band 13 and adapted for engagement by the trim strip T, as best visualized in FIG. 2. An annular clearance groove 25 desirably separates the surface of the slitter band 13 and the surface 24 to facilitate the slitting cooperation of the upper slitter blade 10 and the slitter band.

In a simple, efficient arrangement, the surface 24 comprises, in effect, vacuum roll means to which the trim strip T clings and is deflected from the plane of the travelling web W from the severance point 12 into the chute passage 21. While if preferred the roll surface 24 may be connected to a positive vacuum source, a more simple, and for the present purpose efficiently effective arrangement substantially adopts the paper guide and drive roll arrangement of U.S. Pat. No. 3,405,855. To this end annular air groove means comprising at least one, but preferably a plurality of spaced parallel annular grooves 27 separated by annular lands 28 comprising supporting areas of the surface 24 provide for pressure differential between the ambient air pressure on the outwardly exposed surface of the strip T and negative pressure in the grooves 27 where they are covered by the wrap of the strip T. As explained in said U.S. Pat. No. 3,405,855, the air velocity in the grooves in the high speed rotating roller surface causes a pressure differential to develop between the ambient air and the air within the grooves, thereby developing a partial vacuum so as to pull the web material onto the peripheral roller surface and achieve intimate contact between the web material and the roller surface allowing greater traction than otherwise possible. In other words, instead of the boundary air at the drum surface of the roller and at the opposing surface of the web material tending to float the web material on the drum surface, the air is accommodated in the grooves and due to peripheral velocity acts to develop a mild vacuum whereby to cause the web material to cling to the grooved rotating surface. Where the total width of the surface 24 may be about 1½", there may be five of the grooves 27 equally spaced relative to one another. The grooves may be of generally U-shape, about 0.060" in width and of about 0.050" to 0.060" in depth. The annular land areas 28 between the grooves 27 may be about 0.190" in width.

Through this arrangement, at slow speed such as at start up or threading speed in the winder with which the slitter may be associated, the deflector 22 cooperating with simple frictional drag of the rotary guide surface 24 will assure guidance of the trim strip T down into the chute passage 21. Then at running speed, the pressure differential developed by means of the grooves 27 will assure efficient deflection and guidance of the strip T into the chute passage 21 by action of the grooved rotary surface 24. If the lineal speed in operation is such that there may not be sufficient air differential as a result of normal roll surface and web surface boundary layer air into the grooves 27, additional air may be supplied as by means of an air nozzle 29 positioned to direct air in a volume and at a velocity suitably proportioned to the lineal speed of the surface 24 and the web W to provide the desired pressure differential effect for efficient trim strip deflection and guidance into the chute passage 21.

Figure 4:
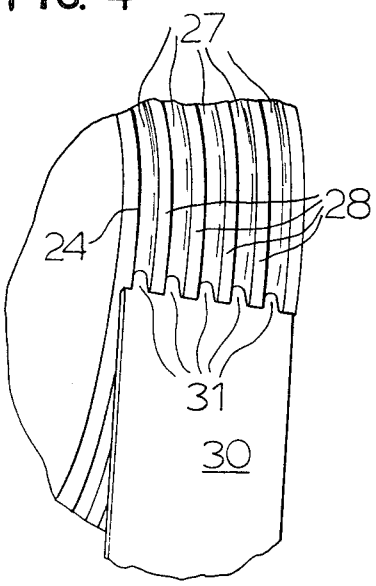
FIG. 4 is a perspective view of that portion of the device shown in FIG. 3.
Figure 3:
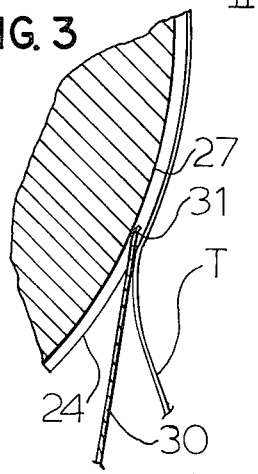
FIG. 3 is an enlarged fragmentary sectional detail view taken substantially along the line III—III of FIG. 2.

At a suitable point spaced from the severance point 12 for efficient reception of the strip T in the chute passage 21, the strip T is stripped from the surface 24. For this purpose, a stripping doctor 30 is positioned on or in association with the rear wall defining the chute 20. In a desirable arrangement, the doctor 30 is of a width substantially the same as the width of the surface 24 and disposed in a suitable stripping angle downwardly away from the surface 24. To assure efficient stripping action of the doctor 30, it has stripper fingers 31 (FIGS. 2, 3 and 4) which are dimensioned to extend freely into the grooves 27 whereby to in effect break the vacuum suction and assure that there will be no hang-up of the strip T at the transition or stripping point along the stripping edge of the stripping doctor 30. Between the fingers 31 the stripping edge of the doctor 30 approaches the land areas 28 as closely as practical without dragging. Desirably, the fingers 31 are beveled or curved at their tips to avoid dragging in the grooves 27. While the fingers 31 are shown as integral extensions from the doctor blade 30, they may, of course, be separately formed in any suitable manner, such as being formed up from wire loops and attached to the body of the stripping doctor blade 30. It may be noted that the stripping point cooperation between the stripping doctor 30 and the surface 24 is at least 90° from the severance point 12, in the illustrated instance slightly greater than 90°.

It will be apparent that efficient trim strip deflection and guidance is attained by means of the grooved trim roll surface 24 with virtually no noise, at least no noise from high velocity air such as experienced with prior arrangements wherein the trim strip is propelled in the chute by high velocity air. Any supplementary air such as may be supplied through the auxiliary air nozzle 29 is adapted to be supplied in a substantially noise-free manner involving no more than possibly a moderate hissing sound which may not even be noticed over the normal machine operating sounds.

It will be understood that variations and modifications may be effected without departing from the spirit and scope of the novel concepts of this invention.

I claim as my invention:

1. A device for handling trim strip in a high speed web slitter having upper and lower rotary slitting means cooperating at a severance point for trimming a strip from the edge portion of a travelling web, and a trim chute for receiving the trim strip, said device comprising:

a cylindrical rotary trim biasing and guiding surface associated coaxially with said lower slitting member, axially spaced from said slitting edge to clear said severance point and adapted for underlying engagement with said trim strip means;

said chute having a front trim strip deflector wall facing said rotary guiding surface in spaced relation, and a rear wall spaced from said front wall and having an edge portion directed generally toward said rotary guiding surface;

annular air grooves in said guiding surface effective in the high speed rotation of said surface to develop negative pressure in the grooves relative to the ambient air for retaining said trim strip in wrapping engagement on said surface for thereby positively transporting the trim strip away from said severance point toward said rear wall;

and a stripping doctor at said edge portion of said rear wall and having stripping assistance fingers projecting into said grooves for stripping the trim strip from said guiding surface for onward movement in said chute.

2. A device according to claim 1, including means for improving high speed efficiency by delivery of supplementary air to said air grooves.

3. A device according to claim 1, wherein said trim chute extends downwardly from said stripping doctor and said stripping doctor effects stripping at a point on said surface spaced about 90° from said severance point.

4. A device according to claim 1, wherein said lower rotary slitting means comprises a cylindrical slitter band surface located in supporting relation to the travelling web, and said rotary trim biasing and guiding surface is located in limited axially spaced clearance groove relation to said band surface and in supporting relation to the trim strip.

5. A device according to claim 1, wherein said doctor comprises an extension on said edge portion of said rear wall.

6. A device according to claim 1, wherein said front wall has an upper end lead-in flange which overlies said severance point and curves toward juncture with said front wall, and a table upstream from said severance point for supporting the web and the edge portion of the web to be trimmed off.

7. A device according to claim 1, wherein said grooves and fingers comprise up to five in number, said grooves being separated by lands, and said fingers being separated by edge portions of said doctor closely approaching said lands.

8. A device for handling trim strip in a web slitter having upper and lower rotary slitting means cooperating at a severance point for trimming a strip from the edge portion of a travelling web, and a trim chute for receiving the trim strip, said device comprising:

a cylindrical rotary trim biasing and guiding surface associated with said lower slitting means and adapted for engagement by said trim strip;

said surface having pressure differential means for retaining said trim strip in wrapping engagement on said surface for thereby positively transporting the trim strip away from said severance point into said chute;

means spaced from said severance point for stripping the trim strip from said surface for onward movement in said chute;

said pressure differential means comprising annular air groove means in said surface effective in the high speed rotation of said surface to develop negative pressure in the groove means relative to the ambient air;

and means improving high speed efficiency by delivery of supplementary air to said air groove means.

9. A method of handling trim strip in a high speed web slitter having upper and lower rotary slitting means cooperating at a severance point for trimming a strip from the edge portion of a travelling web, and a trim chute for receiving the trim strip and comprising a front trim strip deflector wall and a rear wall spaced from said front wall, said method comprising:

engaging said trim strip on a cylindrical rotary trim biasing and guiding surface associated with said lower slitting means;

developing negative air pressure in annular grooves in said guiding surface and relative to the ambient air and thereby retaining said trim strip in wrapping engagement on said rotary surface and positively transporting the trim strip on said surface away from said severance point into said chute;

and projecting into said grooves stripping assistance fingers extending from a stripping doctor located at the edge portion of said rear wall of said chute.

10. A method according to claim 9, comprising supplementing the air in said grooves and thereby enhancing pressure differential between said grooves and the ambient air.

11. A method according to claim 9, comprising effecting said stripping at a point on said surface spaced about 90° from said severance point and directing the stripped trim strip downwardly into the trim chute.

12. A method according to claim 9, which comprises providing said lower rotary slitting means as a cylindrical slitter band surface, supporting the travelling web on said slitter band surface, and locating said rotary trim biasing and guiding surface in limited axially spaced clearance groove relation to said band surface in supporting relation to the trim strip.

13. A method according to claim 9, which comprises deflecting the trim strip toward the chute by a lead-in flange overlying said severance point and curving to join said front wall.

14. A method of handling trim strip in a high speed web slitter having upper and lower rotary slitting means cooperating at a severance point for trimming a strip from the edge portion of a travelling web, and a trim chute for receiving the trim strip, said method comprising:

engaging said trim strip on a cylindrical rotary trim biasing and guiding surface associated with said lower slitting means;

retaining said trim strip in wrapping engagement on said rotary surface by pressure differential and thereby positively transporting the trim strip on said surface away from said severance point into said chute;

at a point spaced from said severance point stripping the trim strip from said rotary surface for onward movement in said chute;

providing said surface with air groove means, and in high speed rotation of said surface developing negative pressure in said groove means relative to the ambient air;

and supplementing the air in said groove means and thereby enhancing pressure differential between said grooves and the ambient air.

* * * * *